US007231169B2

(12) United States Patent
Hashimoto

(10) Patent No.: US 7,231,169 B2
(45) Date of Patent: Jun. 12, 2007

(54) IMAGE FORMING APPARATUS WITH A FIRST TONER AND A LIGHT PERMEABLE SECOND TONER

(75) Inventor: Koichi Hashimoto, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 183 days.

(21) Appl. No.: 11/193,394

(22) Filed: Aug. 1, 2005

(65) Prior Publication Data

US 2006/0029437 A1 Feb. 9, 2006

(30) Foreign Application Priority Data

Aug. 3, 2004 (JP) ..... 2004-227074
Jul. 26, 2005 (JP) ..... 2005-216225

(51) Int. Cl.
*G03G 15/16* (2006.01)

(52) U.S. Cl. ..... 399/296

(58) Field of Classification Search ..... 399/128, 399/129, 296
See application file for complete search history.

(56) References Cited

U.S. PATENT DOCUMENTS 5,926,679 A * 7/1999 May et al. ..... 399/296
6,477,342 B2 11/2002 Komiya et al. ..... 399/98

FOREIGN PATENT DOCUMENTS

| | | | |
|---|---|---|---|
| JP | 5-165383 | | 7/1993 |
| JP | 11-24425 | | 1/1999 |
| JP | 2002-72602 | | 3/2002 |
| JP | 2002229298 A | * | 8/2002 |
| JP | 2003-57963 | | 2/2003 |

* cited by examiner

*Primary Examiner*—David M. Gray
*Assistant Examiner*—Ryan Gleitz
(74) *Attorney, Agent, or Firm*—Fitzpatrick, Cella, Harper & Scinto

(57) ABSTRACT

The image forming apparatus includes a photosensitive member, wherein an electrostatic latent image is formed by illuminating light onto the photosensitive member charged; a developing device for adhering first toner to a portion of the electrostatic latent image to which light is illuminated to form a first toner image; a transferring device for transferring the first toner image onto a transferring medium; an adhering device for adhering second toner having polarity opposite to that of the first toner and light permeability to a portion of the electrostatic latent image to which light is not illuminated; and a light illuminating device for illuminating light onto at least the portion to which the second toner is adhered, after the second toner is adhered and before transferring is performed by the transferring device.

8 Claims, 9 Drawing Sheets

IMAGE FORMING APPARATUS WITH A FIRST TONER AND A LIGHT PERMEABLE SECOND TONER

BACKGROUND OF THE INVENTION

1. Field of the Invention

The present invention relates to an image forming apparatus for forming an image by using an electrophotographic system, and more particularly, it relates to an image forming apparatus such as a copying machine, a printer and the like, including an electrophotographic photosensitive member as an image bearing member and wherein an image is written on the image bearing member by charging and exposing and the image is formed on a transferring material by an image forming process including a developing step, a transferring step using transferring voltage and the like.

2. Related Background Art

In the past, as full color image forming apparatuses using an electrophotographic system, apparatuses of the type adopting an intermediate transferring system have been used more and more.

The intermediate transferring system is a system in which a developer image (toner image) formed on an image bearing member (photosensitive member) is primarily transferred on an intermediate transferring member provided as a second image bearing member in such a manner that, in particular, a plurality of color toner images are successively superimposed and thereafter the toner images laminated or superimposed by the primary transferring are secondarily transferring collectively on a transferring material such as a paper (recording material) or the like.

In this system, in comparison with a direct transferring system in which the toner images from the photosensitive member are superimposed directly on the transferring member, i.e., in comparison with an image forming apparatus in which, for example, the transferring material is conveyed to a contact position between the transferring material and the photosensitive member while fixing or adhering the transferring material to a transferring material conveying member for conveying the transferring material to the contact position and the toner images are transferred from the photosensitive member, since the toner images can be transferred from the intermediate transferring member without any treatment and control on the transferring material (for example, the transferring material is gripped by a gripper or the transferring material is absorbed or the transferring material is curved with a certain curvature or the like), there is obtained an advantage that various kinds of transferring materials from a thin paper (40 g/m$^2$ paper) to a thick paper such as an envelope, a post card, a label paper and the like and transferring materials having various widths and lengths can be selected optionally.

Further, in comparison with a case where a rigid cylinder such as an intermediate transferring drum is used by designing the intermediate transferring member in a belt configuration, degrees of freedom of installation of the intermediate transferring member within the image forming apparatus are increased, so that there is obtained a merit that a main body of the apparatus can be minimized and a cost can be reduced due to effective use of a space.

Regarding the color image forming apparatuses using the plurality of color developers and adopting the intermediate transferring system, in particular the color image-forming apparatuses using the intermediate transferring belt, the following two main types are known:

One of such types is a first type (a so-called four-cycle type) apparatus in which a plurality of developing apparatuses containing different color developers are provided in an image forming portion including one photosensitive member and, when a plurality of color toner images corresponding to image information are formed on the rotating photosensitive member successively for each color by the electrophotographic process, when an every color toner image is formed, the image is primarily transferred onto the intermediate transferring belt contacted with the photosensitive member in the superimposed manner, and the superimposed toner images on the intermediate transferring belt are ultimately transferred onto the transferring material collectively. Namely, the image forming apparatus is designed so that only one image forming portion including one photosensitive member is provided and, following the formation of the toner image on the photosensitive member, the primary transferring onto the intermediate transferring belt is repeated a number of times corresponding to the number of colors to form the plural color composite toner images on the intermediate transferring belt and the toner images are secondarily transferred onto the transferring material collectively.

The other type is a second type (a so-called tandem type) apparatus in which a plurality of image forming portions each including one photosensitive member are provided and the toner image having a color corresponding to the image information is formed on each photosensitive member of each image forming portion by the electrophotographic process and the so formed toner images are primarily transferred, in the superimposed manner, onto the intermediate transferring belt rotated while contacting with the photosensitive members of the plurality of image forming portions and the superimposed toner images on the intermediate transferring belt are ultimately transferred onto the transferring material collectively. Namely, the image forming apparatus is designed so that the photosensitive members are provided in the respective plurality of image forming portions, and, when the intermediate transferring belt is passed by the respective image forming portions, the plurality of toner images are primarily transferred to form the composite toner images and, thereafter, the toner images are secondarily transferred onto the transferring material collectively.

In the image forming apparatuses of the above-mentioned two types, regarding the transferring of the toner images from the photosensitive member(s) to the intermediate transferring belt, in many cases, such transferring is carried out by a transferring device in which a transferring member such as a primary transferring roller contacting with a back side of the intermediate transferring belt is provided in a contacting portion (transferring portion) between a photosensitive member and the intermediate transferring belt and the toner images on the photosensitive member(s) are electrostatically transferred onto the peripheral surface of the intermediate transferring belt by applying transferring voltage (transferring bias) having polarity opposite to charging polarity of the developer (toner) to the transferring member (s).

However, in such image forming apparatuses, there arose a problem that, immediately after the toner image is primarily transferred to the intermediate transferring belt, a part of the developer (toner) constituting the toner image, and particularly of the toner constituting corners of the toner image is dispersed around the toner image, thereby deteriorating image quality.

Such toner dispersal phenomenon is considered to be caused by the following reason.

In a reversal developing system, in comparison with an image area as an image part (exposure part) formed on the photosensitive member on which the toner is rested, a non-image part (non-exposure part) on which the toner is not rested has a high potential condition that potential of the photosensitive member is maintained to primarily charged charging potential and, since there is no toner layer, a thickness of a dielectric layer between the photosensitive member and the transferring member becomes small, so that electrostatic capacity of the non-image part becomes great. In this condition, if the process for transferring the toner image from the photosensitive member to the intermediate transferring belt is carried out, in the area of the non-image part, more charges than in the area of the image part are applied to the intermediate transferring belt. As a result, as shown in FIG. 9, regarding charge distribution on the intermediate transferring belt, plus charging density of the non-image part having no toner becomes greater than that of the image part including the toner.

Since the applied charge has polarity opposite to the charging polarity of the toner, due to such charge distribution, a force for dispersing the toner acts on the toner on the intermediate transferring belt, with the result that, the toner of the toner image is dispersed on a portion of the intermediate transferring belt which has past through the transferring portion.

Particularly, such toner dispersal phenomenon tends to occur immediately after the second color toner image and so on is transferred. Further, also in a case where the developer includes spherical toner, i.e. substantially spherical particles, such a phenomenon tends to occur.

In order to reduce the charge applied to the portion of the intermediate transferring belt corresponding to the non-image portion, Japanese Patent Application Laid-open No. H5-165383 describes a method (pre-transferring exposure) in which a whole longitudinal area of the photosensitive member is exposed before the transferring. In this case, however, a toner holding force on the photosensitive member is reduced, thereby causing a problem that the toner is dispersed before the transferring.

Further, Japanese Patent Application Laid-open No. 2002-72602 describes a technique in which toner having opposite polarity is adhered to a non-exposed portion in the vicinity of a boundary between an exposed portion and the non-exposed portion and, thereafter, light is illuminated onto the surface of the photosensitive member by an electricity removing lamp. With this arrangement, in the Japanese Patent Application Laid-open No. 2002-72602, the toner having the opposite polarity can prevent the exposure of the non-exposed portion in the vicinity of the boundary between the exposed portion and the non-exposed portion, with the result that the toner adhered to the exposed portion is held by the potential which is not completely reduced in the vicinity of the boundary. However, due to such potential which is not completely reduced in the vicinity of the boundary, much charge is applied to the non-image portion of the belt, with the result that the toner dispersal cannot be prevented properly in the transferring portion.

Incidentally, Japanese Patent Application Laid-open No. H11-24425 describes a technique in which volume specific resistance is specified and an intermediate transferring belt has an outermost layer including anti-weather adding agent, and, Japanese Patent Application Laid-open No. 2003-57963 describes a technique in which, after transferring voltage is applied by the transferring member, voltage having polarity opposite to that of the transferring voltage is applied from the back side of the intermediate transferring belt. However, in both cases, it is not possible to prevent the charge having the same polarity as that of the transferring bias from being applied to the area of the intermediate transferring belt corresponding to the non-image portion.

SUMMARY OF THE INVENTION

An object of the present invention is to provide an image forming apparatus which can prevent dispersal of toner transferred from a photosensitive member to a transferring medium.

Another object of the present invention is to provide an image forming apparatus comprising a photosensitive member, a developing device for adhering first toner to a portion (onto which light is illuminated), of an electrostatic latent image formed by illuminating light onto the charged photosensitive member, a transferring device for transferring the first toner image to a transferring medium, an adhering device for adhering light-permeable second toner having polarity opposite to that of the first toner to a portion of the electrostatic latent image onto which the light is not illuminated, and a light illuminating device for illuminating light onto at least an area to which the second toner is adhered, after the first toner and the second toner are adhered to the electrostatic latent image and before the transferring is performed by the transferring device.

The other objects of the present invention will be apparent from the following descriptions.

DESCRIPTION OF THE PREFERRED EMBODIMENTS

Now, an image forming apparatus according to the present invention will be fully explained with reference to the accompanying drawings.

Figure 1:
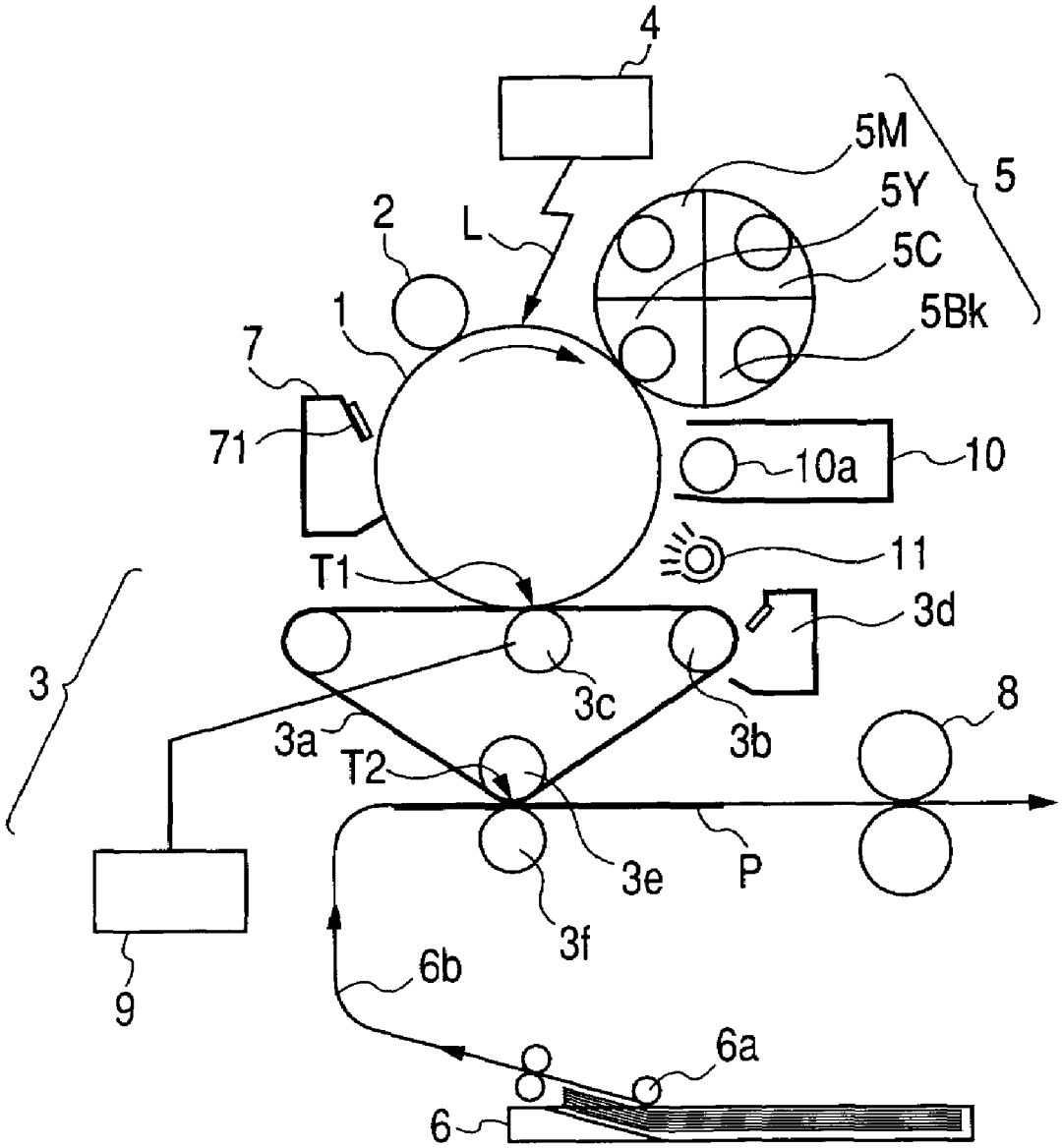
FIG. 1 is a schematic view of an image forming apparatus according to an embodiment of the present invention.
Figure 2A:
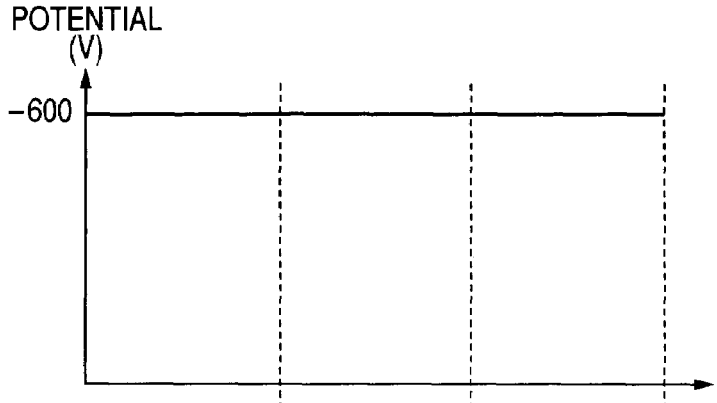
FIGS. 2A, 2B, 2C and 2D are views showing surface potential of a photosensitive member, respectively.
Figure 2B:
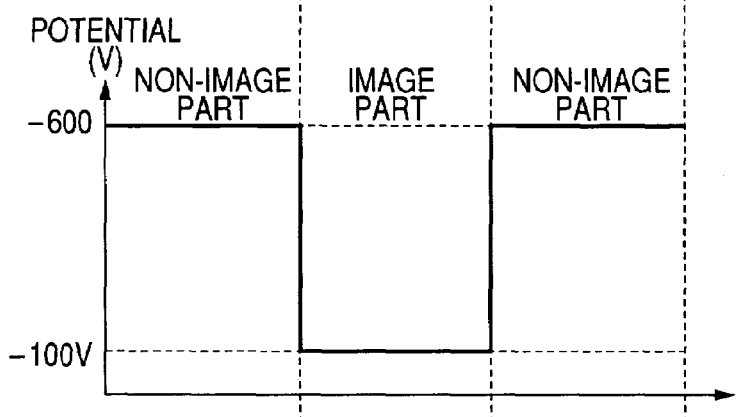
Figure 2C:
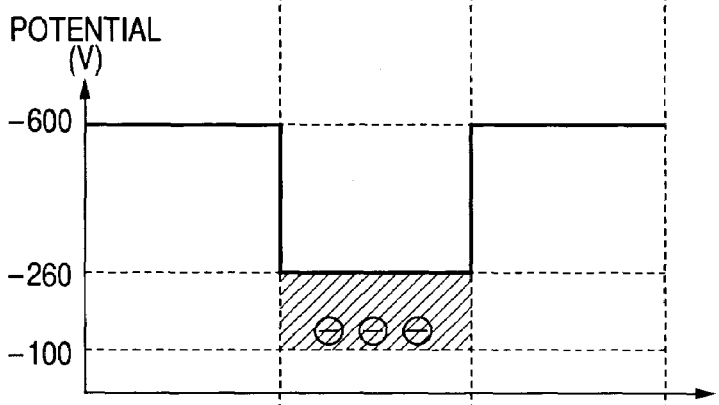
Figure 2D:
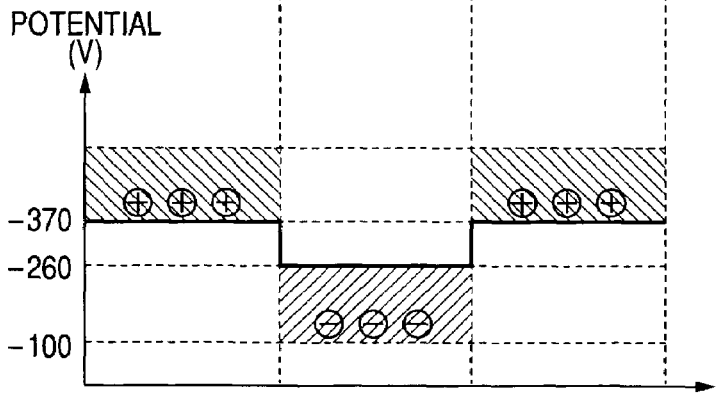

FIG. 1 shows a schematic construction of an image forming apparatus of an electrophotographic type to which the present invention can be applied. The image forming apparatus includes one photosensitive drum 1 as an image bearing member which is rotated in a direction shown by the arrow, and, around the photosensitive drum, there is provided image forming means such as a charging device 2 for performing primary charging, a rotary developing apparatus 5 as a first developing apparatus carrying plural developing devices 5Y, 5M, 5c and 5Bk, a transferring device 3 and a laser beam scanner 4 as an image writing device disposed above the photosensitive drum 1. An image forming portion is constituted by these image forming means. The image forming apparatus utilizes an intermediate transferring system and the transferring device 3 includes an intermediate transferring belt 3*a* as a transferring medium (intermediate transferring member) situated at a position where the transferring device is contacted with the photosensitive drum 1. In the image forming portion, the rotary developing apparatus 5 successively brings the developing devices 5Y, 5M, 5C and 5Bk containing yellow, magenta, cyan and black developers (toners), respectively, to an area opposed to the photosensitive drum 1, so that respective color toner images are successively formed on the photosensitive drum, and such toner images are primarily transferred successively onto the intermediate transferring belt 3*a* in a superimposed manner, and then, the laminated four color toner images are successively secondarily-transferred onto a transferring material P collectively.

In the image forming portion, in order to carry out the primary charging for uniformly charging the photosensitive drum 1 as the photosensitive member, a contact charging roller system utilizing a charging roller (charging member) constituted by conductive rubber is used as the charging device 2. As a result that voltage obtained by overlapping AC voltage (sine wave, 920 Hz, 1100 μA) with DC voltage (−600 V) is used as charging bias, it was found that uniform charging potential of about −600 V can be obtained.

The image forming apparatus includes an original reading device (not shown) having a photoelectric converting element such as CCD and the like in order to obtain image information from outside and an image signal corresponding to the image information of the original is outputted from the original reading device. A semiconductor laser as an image exposing device for exposing the charged photosensitive drum and incorporated in the laser beam scanner illuminates a controlled laser beam L corresponding to the image signal onto a surface of the photosensitive drum 1, thereby forming an electrostatic latent image on the photosensitive drum. Incidentally, an output signal from a computer can be printed out.

The photosensitive drum 1 used in the illustrated embodiment is an OPC photosensitive member having negative charging and is constituted by providing the following first to fourth function layers on an aluminum drum base from the bottom successively:

A first layer is an underlying layer which is a conductive layer having a thickness of about 20 μm and provided to correct defects in an aluminum drum substrate (aluminum substrate) and to prevent occurrence of moire due to laser exposure performed by the laser beam scanner 4.

A second layer is a positive charge injection preventing layer and is a middle resistance layer which serves to prevent positive charges injected from the aluminum substrate from canceling negative charges charged on the surface of the photosensitive drum 1 and has resistance of about $10^6$ Ω·cm adjusted by polyamide resin and methoxy methylation nylon and has a thickness of about 1 μm.

A third layer is a charge generating layer which is a layer obtained by dispersing disazo pigment into resin and having a thickness of about 0.3 μm and which generates pairs of positive and negative charges by laser exposure.

A fourth layer a charge transporting layer which is P-type semiconductor obtained by dispersing hydrazone into polycarbonate resin. Accordingly, the negative charges charged on the surface of the photosensitive drum 1 cannot be shifted through the fourth layer, so that only the positive charges generated in the charge generating layer can be transported to the surface of the photosensitive drum 1.

The photosensitive drum 1 is rotated in a clockwise direction shown by the arrow at a process speed (peripheral speed) of about 200 mm/sec.

In the sequence of the whole image forming apparatus, first of all, the photosensitive drum 1 is uniformly charged by the charging device 2 (primary charging).

Then, scanning exposure is performed by the laser beam L modulated by the image signal to form the electrostatic latent image on the photosensitive drum 1, and the electrostatic latent image is reversal-developed by the rotary developing apparatus 5. Namely, the first toners (yellow toner, magenta toner, cyan toner and black toner) are adhered to a portion of the electrostatic latent image onto which the light is illuminated.

In the image forming apparatus, during the rotation of the rotary developing apparatus 5, the developing devices 5Y, 5M, 5C and 5Bk as the four developing devices are successively opposed to the photosensitive drum 1 to perform the development of the latent image, thereby forming a developer image (toner image). The toner image is constituted by an image part on which the toner is rested by the development and a non-image part on which the toner is not rested. Incidentally, in the illustrated embodiment, each developing device is a two-component contact developing device.

In the image forming apparatus according to the illustrated embodiment, by the rotation of the photosensitive drum 1, the developed toner image is shifted to a primary transferring portion T1 where a primary transferring roller 3*c* is opposed to the photosensitive drum 1. When primary transferring bias having a polarity opposite to that of the developer (toner) in the developing apparatus 5 is applied to the primary transferring roller 3*c* by a power source 9, the toner images are successively transferred onto the intermediate transferring belt 3*a* and are superimposed with each other. The superimposed four color toner images on the intermediate transferring belt 3*a* are transferred onto a transferring material (recording material) P such as paper picked up from a paper feeding cassette 6 and advanced by a paper feeding roller 6*a* and a paper feeding guide 6*b*, at a secondary transferring portion T2 where the transferring material is pinched between a secondary transferring roller 3*f* and a back-up roller 3*e*.

The primary transferring roller 3*c* and the secondary transferring roller 3*f* as transferring members used in the transferring device 3 in the illustrated embodiment each has a core metal and cylindrical conductive foam rubber formed on the outer periphery of the metal core. A diameter of the primary transferring roller 3*c* is 24 mm and a diameter of the secondary transferring roller 3*f* is 28 mm, and, regarding both of the primary and secondary transferring rollers 3*c* and 3*f*, volume resistance is $10^6$-$10^8$ Ω·cm.

Further, the back-up roller 3*e* as a support roller for the intermediate transferring belt 3*a*, which is contacted with the secondary transferring roller 3*f* with the interposition of the intermediate transferring belt 3*a* at the secondary transferring portion T2, is constituted by coating conductive rubber having volume resistance of $10^6$-$10^8$ Ω·cm on a surface of a metallic roller.

The primary transferring roller 3*c* is rotatably supported by bearing members at its both ends and is disposed in parallel with a generating line of the photosensitive drum 1 and is urged against the photosensitive drum 1 with the interposition of the transferring belt 3*a* by urging means such as a spring with a constant force. Application of the transferring voltage is performed by using conductive resin in the end bearings.

The intermediate transferring belt 3*a* is an endless belt which is constituted by dispersing conductive material in a substrate made of polyimide or the like and has volume resistance adjusted to $10^5$-$10^{12}$ Ω·cm. The intermediate transferring belt 3*a* is rotatingly driven at a speed of 200 mm/sec same as the peripheral speed of the photosensitive drum 1 by means of a drive roller 3*b* situated at an upstream side of the primary transferring portion T1 in a shifting direction of the intermediate transferring belt 3*a*.

After the superimposed four-color toner images are transferred to the transferring material P, residual toner remaining on the intermediate transferring belt 3*a* is removed by an intermediate transferring belt cleaning member 3*d* which can freely be engaged with and disengaged from the surface of the intermediate transferring belt 3*a*. During the primary transferring, the intermediate transferring belt cleaning member 3*d* is spaced apart from the surface of the intermediate transferring belt 3*a* so that the toner images before the secondary transferring are not distorted.

Toner which is not transferred and remains on the surface of the photosensitive drum 1, and, dispersal preventing toner (fully described later) which has opposite polarity and which is not transferred to the intermediate transferring belt 3*a* are removed from the surface of the photosensitive drum 1 by a blade-shaped cleaning member 71 of a cleaning device 7. After the residual toner is removed, the photosensitive drum 1 is used again for next image formation.

The transfer material P to which the toner images were transferred is sent to a fixing device (heat roller fixing device) 8, where the images are fixed.

In the above-mentioned image forming apparatus of intermediate transferring type, according to the illustrated embodiment, toner dispersal prevention from the intermediate transferring belt 3*a* which was one of problems in the prior art is implemented.

Firstly, second developer (second toner) having charging polarity opposite to charging polarity of image forming first developer (first toner) used in the developing process by the developing apparatus 5 is contained, as "dispersal preventing toner", in a second developing apparatus (referred to as "dispersal prevention developing apparatus" hereinafter) A process (referred to as "dispersal prevention developing process" hereinafter) for performing development with the dispersal preventing toner between the primary charging process of the charging device 2 and the primary transferring process onto the intermediate transferring belt 3*a* is provided, thereby controlling so that the absolute value of the potential of the non-image part on the photosensitive drum 1 is decreased to reduce potential difference between the image part and the non-image part.

In the illustrated embodiment, as shown in FIG. 1, the dispersal prevention developing apparatus 10 for developing the dispersal preventing toner having the opposite polarity in the non-image part for each color is opposed to the photosensitive drum 1 between the rotary developing apparatus 5 and the primary transferring position T1. The developing apparatus 10 includes a dispersal prevention developing sleeve 10*a* as a dispersal preventing toner bearing member having an exposed surface opposed to the photosensitive drum 1 and serving to, by its rotation, convey the toner contained therein to the surface of the photosensitive drum 1. Developing bias is applied to the developing sleeve 10*a* in order to fly the toner toward the photosensitive drum 1. In the illustrated embodiment, in order not to peel off the toner forming the image, the developing sleeve 10*a* is not contacted with the photosensitive drum 1. As the dispersal preventing toner having the opposite polarity, transparent toner is used so that, if the toner is transferred, the image is not influenced by the transferred toner. Namely, the developing apparatus 10 is an adhering device for fixing the light permeable second toner having the polarity opposite to that of the first toner to a portion of the electrostatic latent image to which the light is not illuminated.

Secondly, the toner having the polarity opposite to that of the image forming toner is rested by the dispersal prevention developing operation, and full surface exposure (pre-transferring exposure) is performed so that the absolute value of the potential of the non-image part is decreased to reduce a charge amount injected in the intermediate transferring belt 3*a* corresponding to the non-image part during the application of the transferring bias. In this way, the countermeasure for preventing the toner dispersal on the intermediate transferring belt 3*a* is executed.

In the illustrated embodiment, an LED as a pre-transferring exposure device (hereinafter referred to as "pre-exposure device") 11 for exposing the whole longitudinal area of the photosensitive drum 1 is provided at a downstream side of the dispersal prevention developing apparatus 10 in the rotational direction of the photosensitive drum 1.

Incidentally, in this case, since the toner was already rested on the image part, the light does not pass through the image part, so that the potential of the image part is not changed. Namely, the pre-transferring exposure device is a light illuminating device for illuminating the light onto at least a portion to which the second toner is adhered, after the first and second toners are adhered to the electrostatic latent image and before the transferring is performed by the transferring device.

Now, image forming conditions will be fully explained with reference to FIGS. 2A to 2D.

(1) In the primary charging process, the photosensitive drum 1 is uniformly charged to about −600 V by means of the charging member 2.

(2) On the basis of the sent image information, the laser beam scanner 4 performs the image exposure with respect to the surface of the photosensitive drum 1 which has uniform potential of −600 V. The surface potential of the photosensitive drum 1 at the image part of the toner image i.e. the area in which the image exposure is performed is reduced to about −100 V. The non-image part in which the image exposure is not performed remains at the potential of −600 V.

(3) By applying the developing bias obtained by overlapping AC voltage with DC voltage of −300 V to for example the two-component contact developing device 5Y mounted on the rotary developing apparatus 5 and opposed to the photosensitive drum 1, the first toner is adhered to the portion of the photosensitive drum 1 having the surface potential of about −100 V, thereby developing the electrostatic latent image to form the toner image.

(4) Thereafter, by applying DC voltage of −350 V to the developing sleeve 10*a* of the dispersal prevention developing device 10, the second toner is adhered to the portion of the photosensitive drum 1 having the surface potential of about −600 V, thereby developing the non-image part.

Figure 3:
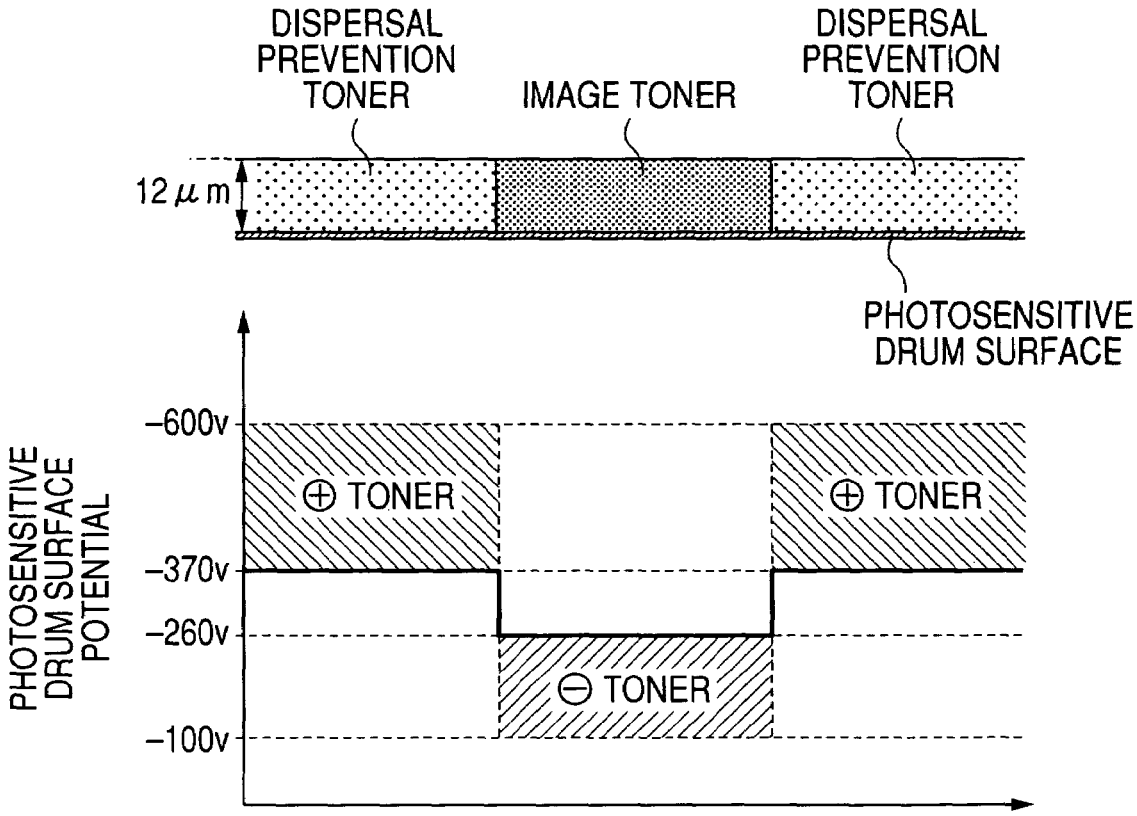
FIG. 3 is a view showing a relationship between the surface potential of the photosensitive member and a condition of toner on the photosensitive member.

By performing the image forming operations (1) to (4), as shown in FIG. 3, it was found that the surface potential of the area in which the image toner is developed becomes about −260 V and the surface potential of the area in which the dispersal preventing toner is developed becomes about −370 V. The dispersal preventing toner was developed to have the same thickness (about 12 μm) as the image toner.

Figure 4:
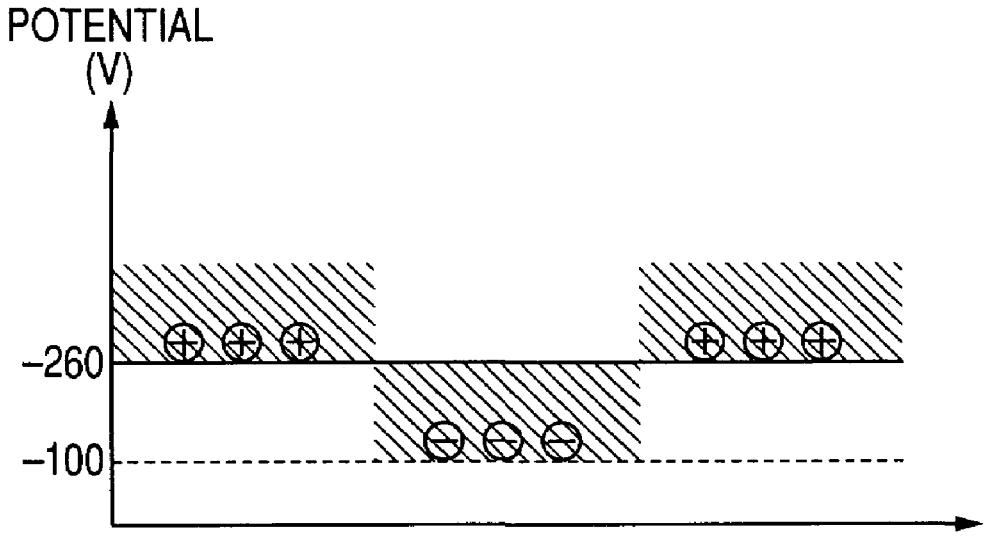
FIG. 4 is a view showing the surface potential of the photosensitive member exposed before transferring.

In the illustrated embodiment, the whole longitudinal (axial) area of the photosensitive drum is pre-exposed by the pre-exposure device 11 to decrease the potential of the non-image part, as shown in FIG. 4.

Incidentally, in this case, since the toner was already rested on the image part, the light does not pass through the image part, so that the potential of the image part is not changed. In contrast, since the toner developed in the non-image part is transparent, the light passes through the non-image part to decrease the potential thereof.

Here, as comparative examples, in a case where the dispersal preventing toner was not used and in a case where the above-mentioned operations (1) to (4) were performed and the pre-exposure was not performed (sample No. 0) and in a case where the pre-exposure was performed with three different light amounts (sample No. 1, No. 2 and No. 3), a relationship between the potential of the area in which the dispersal preventing toner was developed, the potential of the image toner and the level of the dispersal on the intermediate transferring belt 3*a* in this case was checked. A result is shown in the following Table 1:

In the Table 1, symbols showing the dispersal lever are as follows: x: existence of dispersal; Δ: existence of little dispersal; and ○: none of dispersal:

TABLE 1

| Sample No. | 0 | 1 | 2 | 3 | Comparative example |
|---|---|---|---|---|---|
| Pre-exposure level | none | −1 | 2 | 3 | None |
| Image part potential (V) | −260 | −258 | −250 | −250 | −260 |
| Non-image part potential | −370 | −250 | −150 | −50 | −600 |
| Dispersal | Δ | ○ | ○ | ○ | x |

In the comparative example in which the developing operation is not performed by the dispersal preventing toner, since the potential of the non-image part of the photosensitive drum is equal to the charging voltage (−600 V) of the photosensitive drum primarily charged by the charging member, the potential difference with respect to the transferring voltage becomes great, and, since there is no toner layer, the electrostatic capacity becomes great, with the result that, even in the same voltage, much charges are injected in the intermediate transferring belt. Consequently, the toner dispersal will occur by the charges injected in the non-image part of the intermediate transferring belt after the transferring.

In the sample No. 0 in which the dispersal preventing toner is merely developed, since the toner having the opposite polarity is developed on the non-image part of the photosensitive drum, the potential of the non-image part becomes lower than that in the comparative example. Consequently, the dispersal level is more improved than in the comparative example. It can be found that, by performing the dispersal prevention developing operation, the dispersal preventing effect is enhanced.

Further, by comparing the samples No. 1, No. 2 and No. 3 in which the light amount of the pre-exposure is changed with each other, it can be found that, by decreasing the potential of the non-image part of the photosensitive drum 1 below the potential of the image part, the amount of charges poured into the intermediate transferring belt 3*a* corresponding to the non-image part upon application of the transferring voltage becomes small, thereby improving the dispersal.

In general, in a condition that the dispersal preventing toner such as the transparent toner is not developed, if the pre-exposure is performed to decrease the potential of the non-image part below the potential of the image part, the toner holding force on the photosensitive drum is reduced to generate the dispersal of toner. However, in the illustrated embodiment, since the dispersal preventing toner is developed adjacent to the image toner, preferably at the same level as the image toner as explained with reference to FIG. 3, the dispersal due to the pre-exposure is not generated.

Incidentally, since the dispersal preventing toner is charged with polarity opposite to that of the image toner, the dispersal preventing toner is not transferred to the intermediate transferring belt 3*a* by the transferring voltage, with the result that the image is not influenced. If a small amount of toner is transferred to the transferring belt, since the toner is transparent, the image is almost not influenced.

In this way, in the illustrated embodiment, by developing the non-image part with the toner having the opposite polarity to reduce the potential difference between the non-image part and the image part, the toner dispersal preventing effect can be achieved, and further, for example, by performing the full surface exposure before the transferring, the potential of the non-image part is further reduced, thereby the dispersal preventing effect can be further enhanced.

Figure 5:
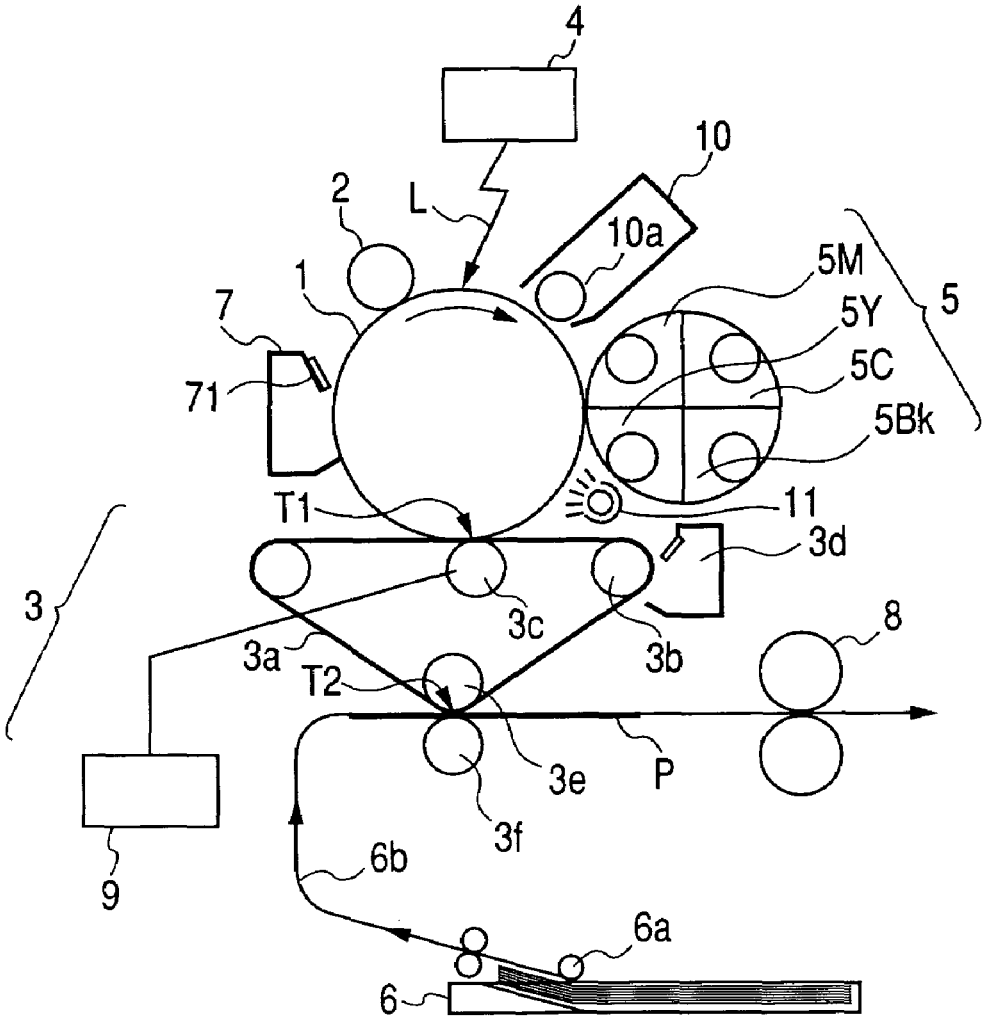
FIG. 5 is a schematic view of an image forming apparatus according to another embodiment of the present invention.

FIG. 5 shows a schematic construction of an electrophotographic image forming apparatus according to another embodiment of the present invention. In the embodiment shown in FIG. 1, while the image toner and the dispersal preventing toner are developed in order, in this embodiment, the dispersal preventing toner is developed and then the image toner is developed.

In the embodiment shown in FIG. 1, while the dispersal prevention developing apparatus 10 is disposed at the downstream side of the rotary developing apparatus 5 in the rotational direction of the photosensitive drum 1, in this embodiment, the dispersal prevention developing apparatus 10 is provided at an upstream side of the rotary developing apparatus 5 in the rotational direction of the photosensitive drum 1. The other arrangements are the same as the previous embodiment.

Figure 6:
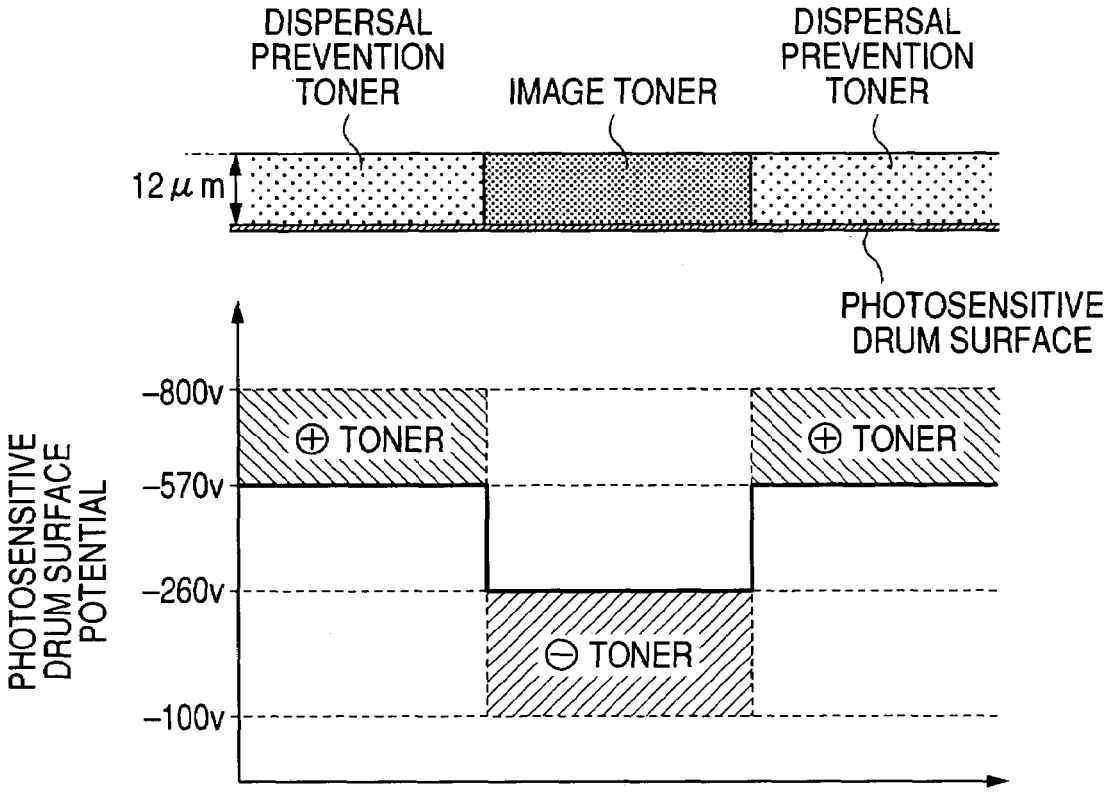
FIG. 6 is a view showing a relationship between surface potential of a photosensitive member and a condition of toner on the photosensitive member.

Now, image forming conditions in this embodiment will be fully explained with reference to FIG. 6.

(1) In the primary charging process, the photosensitive drum 1 is uniformly charged to about −800 V by means of the charging device 2.

(2) On the basis of the sent image information, the laser beam scanner 4 performs the image exposure with respect to the photosensitive drum 1 which has uniform potential of −800 V. The surface potential of the photosensitive drum 1 at the image part i.e. the area in which the image exposure is performed is reduced to about −100 V. The non-image part remains to the potential of −800 V.

(3) Then, by applying the developing bias obtained by overlapping AC voltage with DC voltage of −550 V to the developing sleeve 10*a* of the dispersal prevention developing apparatus 10, the second toner is adhered to the non-image part, thereby performing the development.

(4) Thereafter, by applying the developing bias comprised of DC voltage of −300 V to for example the developing device 5Y mounted on the rotary developing apparatus 5 and opposed to but not contacted with the photosensitive drum 1, the first toner is adhered to the portion of the photosensitive drum 1 having the surface potential of about −100 V, thereby developing the electrostatic latent image with the image toner.

After the above-mentioned image forming operations (1) to (4) are performed, it was found that the surface potential of the area in which the image toner is developed becomes about −260 V and the surface potential of the area in which the dispersal preventing toner is developed becomes about −570 V. The dispersal preventing toner was developed to have the same thickness (about 12 μm) as the image toner.

In the illustrated embodiment, the whole longitudinal area of the photosensitive drum is pre-exposed by the pre-exposure device 11 to decrease the potential of the non-image part.

Incidentally, in this case, since the toner was already rested on the image part, the light does not pass through the image part, so that the potential of the image part is not changed. In contrast, since the toner developed in the non-image part is transparent, the light passes through the non-image part to decrease the potential thereof.

When the full surface exposure was performed with the light amount of the pre-exposure level 3 in the sample No. 3 in the Table 1 according to the previous embodiment, it was found that the surface potential of the image part of the photosensitive drum 1 becomes −250 V and the surface potential of the non-image part becomes −50 V, thereby preventing the toner dispersal.

Incidentally, as is in the illustrated embodiment, in the case where the developing operation for dispersal prevention is performed prior to the normal developing operation, the primary charging potential is maintained to higher potential (−800 V), in comparison with the previous embodiment in which the normal developing operation is performed prior to the developing operation for dispersal prevention (−600 V).

This purpose is to prevent the fact that the image toner is developed in the non-image part in vain, by maintaining the potential difference between DC voltage for the normal image development and the non-image part to 200 V or more. Namely, by performing the development for the dispersal prevention prior to the normal development, since the surface potential of the non-image part is reduced by about 200 V, the charging potential is previously increased by 200 V.

In comparison with the previous embodiment, in the illustrated embodiment, if the toner contained in the upstream side developing apparatus enters into the downstream side developing apparatus in the rotational direction of the photosensitive drum 1, since the upstream side developing apparatus is the dispersal prevention developing apparatus 10 containing the transparent toner, the color of the toner is almost not influenced. In particular, in an image forming apparatus in which plural color developing devices are arranged around one photosensitive drum to form a multi-color image, it is possible to prevent the mixing of color between the image toners.

Next, the other embodiment of the present invention will be explained.

Figure 7:
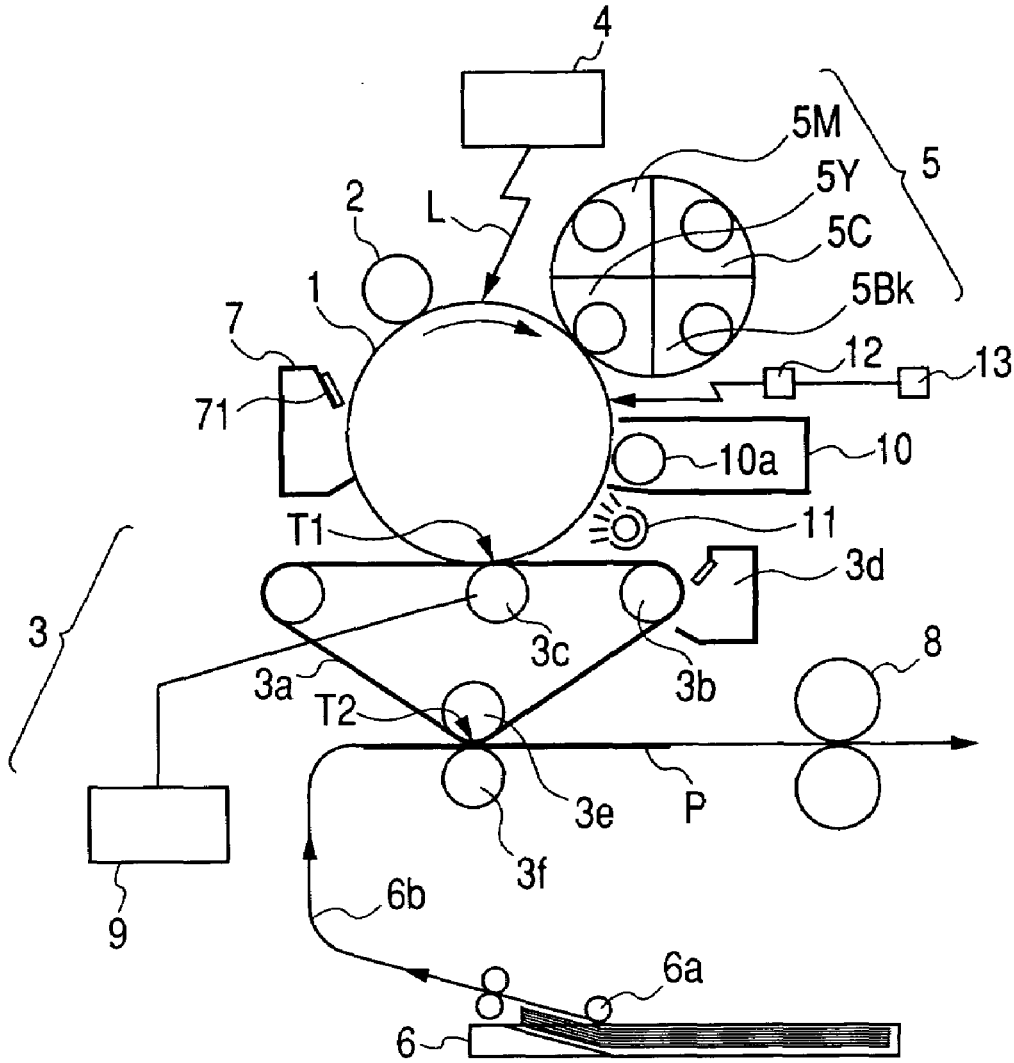
FIG. 7 is a schematic view of an image forming apparatus according to the other embodiment of the present invention.

FIG. 7 shows a schematic construction of an electrophotographic image forming apparatus according to the other embodiment of the present invention. In this embodiment, after the electrostatic latent image is formed by the first exposure device 4 and the toner image is formed by the developing apparatus 5, by exposing an area other than the image part of the toner image and neighborhood i.e. the non-image part other than in and around the image by means of a second image writing device 12 as a second exposure device, consumption of the dispersal preventing toner is suppressed.

In an image forming apparatus having a construction similar to that of the previous embodiment, a laser beam scanner 12 as the second image writing device is further provided between the rotary developing apparatus 5 and the dispersal prevention developing apparatus 10 around the photosensitive drum 1. In this embodiment, while the laser beam scanner 12 has a construction similar to that of the laser beam scanner 4 as the first writing device, another construction may be used.

Exposure information obtained by converting image information from a personal computer or image information read by an image reading device by control means 13 in the apparatus is sent to the laser beam scanner 12 as the second writing device according to the illustrated embodiment, in order to expose an area of 5 mm neighborhood around the image. Namely, after the first toner is adhered and before second toner is adhered, light is illuminated onto a part of the portion of the electrostatic latent image on which the light is not illuminated.

Figure 8:
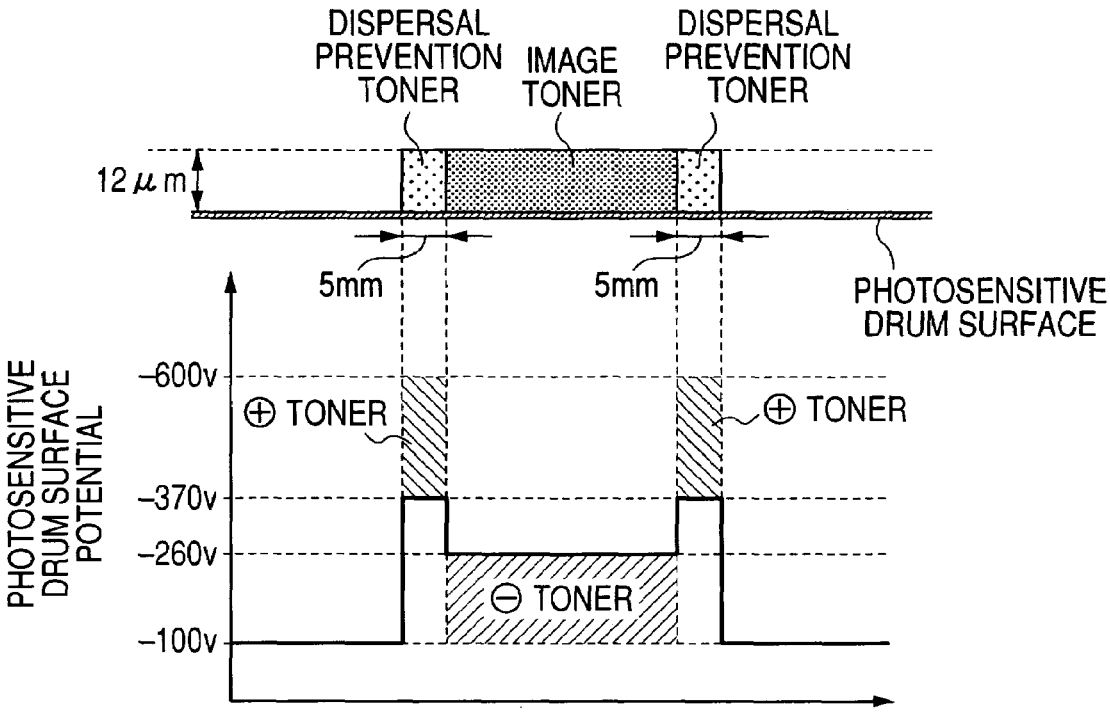
FIG. 8 is a view showing a relationship between surface potential of a photosensitive member and a condition of toner on the photosensitive member.
Figure 9:
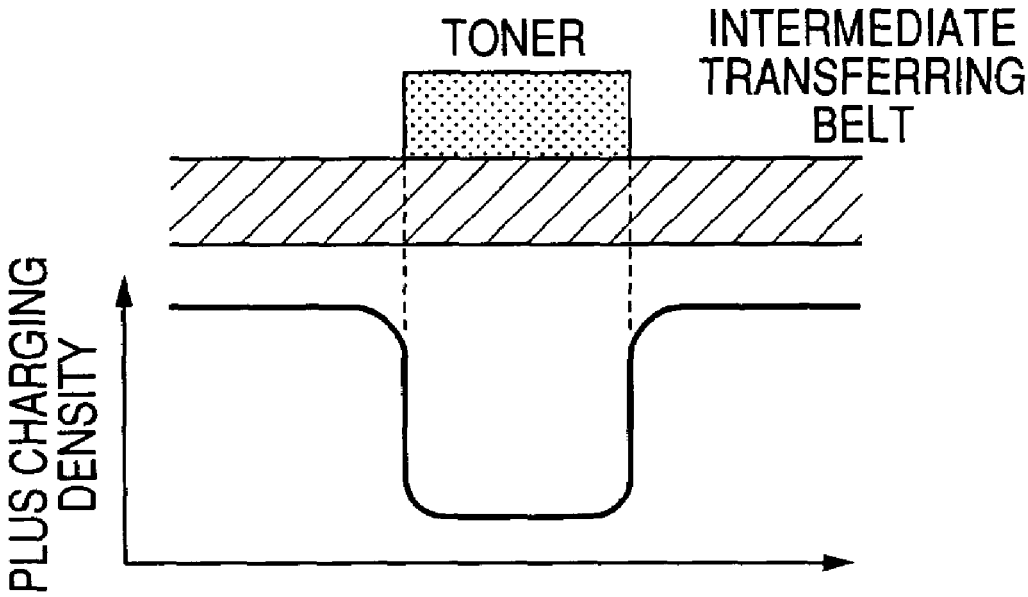
FIG. 9 is a view showing density distribution of plus charges on a surface of an intermediate transferring member after primary transferring.

Now, image forming conditions in this embodiment will be fully explained with reference to FIG. 8.

(1) In the primary charging process, the photosensitive drum 1 is uniformly charged to about −600 V by means of the charging member 2.

(2) On the basis of the sent image information, the laser beam scanner 4 performs the image exposure with respect to the photosensitive drum 1 which has uniform potential of −600 V. The surface potential of the photosensitive drum 1 at the image part i.e. the area in which the image exposure is performed is reduced to about −100 V. The non-image part remains to the potential of −600 V.

(3) By applying the developing bias obtained by overlapping AC voltage with DC voltage of −300 V to for example the two-component contact developing device 5Y mounted on the rotary developing apparatus 5 and opposed to the photosensitive drum 1, the first toner is adhered to the portion of the photosensitive drum 1 having the surface potential of about −100 V, thereby developing the electrostatic latent image to form the toner image.

(4) In the non-image part, by exposing the area of 5 mm neighborhood around the image part by means of the laser beam scanner 12, the potential of the exposed part of the photosensitive drum 1 is decreased to about −100 V. In this way, since the surface potential of the part of the photosensitive drum 1 exposed by the laser beam scanner 12 is decreased to −100 V, regarding the surface potential of the non-image part of the photosensitive drum 1, as shown in FIG. 8, only the area of 5 mm neighborhood around the image part is maintained to a high condition i.e. to −600 V similar to the primary charging potential.

(5) Thereafter, by applying DC voltage of −350 V to the developing sleeve 10*a* of the dispersal prevention developing device 10, the second toner is adhered to the non-image part of the photosensitive drum 1, thereby performing the development. In this case, as shown in FIG. 8, since only the area of 5 mm neighborhood around the image part has higher surface potential than that of the non-image part of the photosensitive drum 1 which is not exposed by the laser beam scanner 12, only such area is developed. Namely, the dispersal preventing toner is adhered to only the area of 5 mm neighborhood around the image part.

By performing the image forming operations (1) to (5), it was found that the surface potential of the area in which the image toner is developed becomes about −260 V and the surface potential of the area of 5 mm neighborhood around the image part in which the dispersal preventing toner is developed becomes about −370 V. The dispersal preventing toner was developed to have the same thickness (about 12 μm) as the image toner. The other non-image part has the surface potential of −100 V.

Thereafter, when the whole surface exposure was performed with the pre-exposure level 3 in the previous embodiment, it was found that the toner dispersal can be prevented, similar to the previous embodiment.

Incidentally, in this case, since the toner was already rested on the image part, the light does not pass through, the image part, so that the potential of the image part is not changed. In contrast, since the toner developed in the non-image part is transparent, the light passes through the non-image part to decrease the potential thereof.

Namely, by providing the second image writing device 12, it is not necessary that the dispersal preventing developing operation is performed throughout the whole non-image part, with the result that the consumption of the dispersal preventing toner can be suppressed and the cost can be reduced.

Incidentally, regarding the dispersal prevention, since the dispersal occurs at only the area around the image part, as mentioned above, by performing the dispersal preventing development at said area, the dispersal prevention is achieved.

As explained in the previous embodiments, in the present invention, by developing the non-image part with the toner having the polarity opposite to that in the image formation, the toner dispersal which was generated in the toner image transferring from the photosensitive drum to the intermediate transferring belt can be suppressed and further, by exposing the whole image before the transferring, the toner dispersal preventing effect can be further enhanced.

Incidentally, in the above-mentioned explanation, regarding the image forming apparatus of intermediate transferring type, while the toner dispersal caused in the intermediate transferring belt was explained, also in an image forming apparatus of direct transferring type in which the toner images are directly transferred from the photosensitive drum to the transferring material as the transferring medium, the present invention can be applied, with the result that the toner dispersal preventing effect from the transferring material can be obtained.

Further, in the above-mentioned embodiments, while an example that the transparent toner is used as the second toner was explained, the second toner is not necessarily to be transparent, any toner which can pass through light having a wavelength band capable of decreasing the potential of the photosensitive member among the lights from the light illuminating device may be used.

Further, in the previous embodiments, while an example that the light from the light illuminating device is illuminated onto the whole surface of the photosensitive member was explained, such light may illuminate on only the non-image part other than the image part. Namely, any light from the light illuminating device which can illuminate the light onto at least a portion to which the second toner is adhered may be used.

Further, also in an image forming apparatus of tandem type having a plurality of image forming portions each including a photosensitive drum, the similar effect can be obtained by providing the dispersal prevention developing apparatus and/or the pre-exposure device in each image forming portion.

Further, even in a case where an intermediate transferring drum is used in place of the intermediate transferring or even in a case where an image writing device of other type is used, the present invention can be applied, and, it should be noted that dimensions, materials, configurations and relative positions of constructional elements of the above-mentioned image forming apparatuses do not limit the scope of the present invention, except that they are specified particularly.

While the present invention was explained with reference to the preferred embodiments thereof, the present invention is not limited to such embodiments and various can be made within the scope of the present invention.

This application claims priority from Japanese Patent Application Nos. 2004-227074 filed on Aug. 3, 2004 and 2005-216225 filed on Jul. 26, 2005, which are hereby incorporated by reference herein.

What is claimed is:

1. An image forming apparatus comprising:

a photosensitive member on which an electrostatic latent image is formed by illuminating light onto said photosensitive member charged;

a developing device for adhering first toner to a portion of said electrostatic latent image to which light is illuminated;

a transferring device for transferring said first toner onto a transferring medium;

an adhering device for adhering second toner having polarity opposite to that of said first toner and light permeability to a portion of said electrostatic latent image to which light is not illuminated; and a light illuminating device for illuminating light onto at least the portion to which said second toner is adhered, after said first toner and said second toner are adhered to said electrostatic latent image and before transferring is performed by said transferring device.

2. An image forming apparatus according to claim 1, wherein said light illuminating device illuminates the light onto a whole surface of said photosensitive member.

3. An image forming apparatus according to claim 1, wherein, after said first toner is adhered to said electrostatic latent image, said second toner is adhered to said electrostatic latent image.

4. An image forming apparatus according to claim 1, wherein said second toner is permeable to light having a wavelength band capable of reducing potential of said photosensitive member, among lights from said light illuminating device.

5. An image forming apparatus according to claim 1, wherein said second toner is transparent.

6. An image forming apparatus according to claim 1, wherein, after said first toner is adhered to said electrostatic latent image and before said second toner is adhered to said electrostatic latent image, light is illuminated onto a part of a portion of said electrostatic latent image onto which light is not illuminated.

7. An image forming apparatus according to claim 1, wherein said transferring medium is an intermediate transferring member, and an image with the first toner on said photosensitive member is transferred onto said intermediate transferring member and the image on said intermediate transferring member is transferred onto a transferring material.

8. An image forming apparatus according to claim 1, wherein said transferring medium is a transferring material.

* * * * *

UNITED STATES PATENT AND TRADEMARK OFFICE

CERTIFICATE OF CORRECTION

PATENT NO. : 7,231,169 B2
APPLICATION NO. : 11/193394
DATED : June 12, 2007
INVENTOR(S) : Koichi Hashimoto It is certified that error appears in the above-identified patent and that said Letters Patent is hereby corrected as shown below:

COLUMN 1
Line 65, “image-forming” should read --image forming--.

COLUMN 5
Line 5, “5c” should read --5C--;
Line 30, “result” should read --result,--.

COLUMN 6
Line 1, “layer” should read --layer is--; and “P-type” should read --a P-type--;
Line 52, “embodiment” should read --embodiment,--.

COLUMN 7
Line 47, “hereinafter)” should read --hereinafter.--.

COLUMN 8
Line 47, “image” should read --image,--;
Line 48, “i.e.” should read --i.e.,--;
Line 53, “to for example” should read --to, for example,--.

COLUMN 9
Line 26, “lever” should read --levels--;
Line 33, Table 1, “-l” should read --1--.

COLUMN 10
Line 56, “part i.e.” should read --part, i.e.,--;
Line 57, “performed” should read --performed,--;
Line 65, “to for example” should read --to, for example,--;
Line 67, “opposed to” should read --opposed to,--.

COLUMN 11
Line 66, “neighborhood i.e.” should read --neighborhood, i.e.,--.

COLUMN 12
Line 32, “part i.e.” should read --part, i.e.,--;
Line 33, “performed is” should read --performed, is--;
Line 36, “to for example” should read --to, for example,--;
Line 52, “high condition” should read --high condition,--;
Line 53, “i.e. to” should read --i.e., to--.

UNITED STATES PATENT AND TRADEMARK OFFICE

CERTIFICATE OF CORRECTION

PATENT NO. : 7,231,169 B2
APPLICATION NO. : 11/193394
DATED : June 12, 2007
INVENTOR(S) : Koichi Hashimoto It is certified that error appears in the above-identified patent and that said Letters Patent is hereby corrected as shown below:

COLUMN 13

Line 13, "does not pass through, the" should read --did not pass through the--;
Line 50, "transparent, any" should read --transparent. Any--.

Signed and Sealed this

Twenty-fifth Day of March, 2008

JON W. DUDAS
*Director of the United States Patent and Trademark Office*